US009925427B2

(12) United States Patent
Bischmann et al.

(10) Patent No.: US 9,925,427 B2
(45) Date of Patent: Mar. 27, 2018

(54) STAND ALONE GOLF CLUB WITH AUXILIARY GROUND ENGAGING SUPPORT MEMBERS

(71) Applicants: Lawrence C. Bischmann, Cardiff by the Sea, CA (US); Bradley V. Adams, Jupiter, FL (US); David P. Billings, McKinney, TX (US)

(72) Inventors: Lawrence C. Bischmann, Cardiff by the Sea, CA (US); Bradley V. Adams, Jupiter, FL (US); David P. Billings, McKinney, TX (US)

( * ) Notice: Subject to any disclaimer, the term of this patent is extended or adjusted under 35 U.S.C. 154(b) by 0 days.

(21) Appl. No.: 15/070,894

(22) Filed: Mar. 15, 2016

(65) Prior Publication Data

US 2017/0266517 A1 Sep. 21, 2017

(51) Int. Cl.
*A63B 53/04* (2015.01)
*A63B 53/00* (2015.01)

(52) U.S. Cl.
CPC ..... *A63B 53/007* (2013.01); *A63B 53/0487* (2013.01); *A63B 2053/0433* (2013.01)

(58) Field of Classification Search
CPC ..... A63B 53/0487; A63B 53/007; A63B 2053/0433
See application file for complete search history.

(56) References Cited

U.S. PATENT DOCUMENTS

| | | | | | |
|---|---|---|---|---|---|
| 4,010,958 | A * | 3/1977 | Long | A63B 53/0487 | 172/371 |
| D328,481 | S * | 8/1992 | Antonious | D21/742 | |
| 5,213,332 | A * | 5/1993 | Fahy | A63B 69/3685 | 473/243 |
| 5,282,622 | A * | 2/1994 | Evans | A63B 69/3685 | 473/243 |
| 6,634,956 | B1 * | 10/2003 | Pegg | A63B 53/007 | 473/251 |
| 7,494,422 | B2 * | 2/2009 | Pegg | A63B 53/007 | 473/292 |
| 2006/0240905 | A1 * | 10/2006 | Haney | A63B 53/0487 | 473/313 |

FOREIGN PATENT DOCUMENTS

| | | | | |
|---|---|---|---|---|
| WO | WO 0043081 A1 * | 7/2000 | ..... | A63B 53/0487 |

* cited by examiner

*Primary Examiner* — Stephen Blau
(74) *Attorney, Agent, or Firm* — N. J. Aquilino

(57) ABSTRACT

A stand-alone putter structured and weight balanced enabling the putter to stand upright in a favorable lie and loft position on a putting surface without any outside support formed of a club head, a shaft connected to the club head, and having a gripping area at the upper end of the shaft. The club head is conventional in design and includes a ball striking face, a rear surface, a heel, a toe, an upper surface and a bottom sole structured to serve as a first ground support surface for the putter in a conventional use position with the bottom sole lying on a putting surface. The club head further includes at least one additional ground engaging support member extending outwardly from the club head forming a second ground support member to maintain the putter in a stand-alone position on the putting surface.

4 Claims, 12 Drawing Sheets

FIG 8
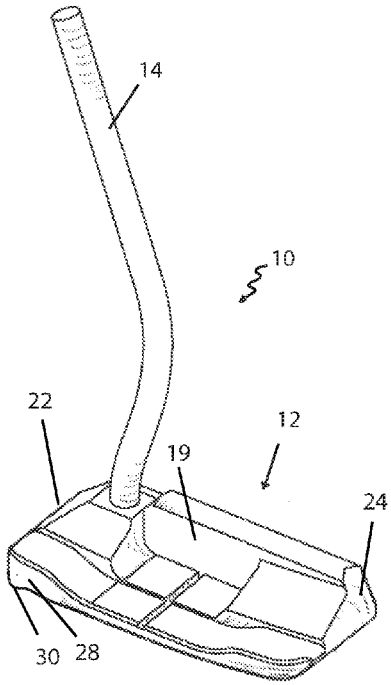
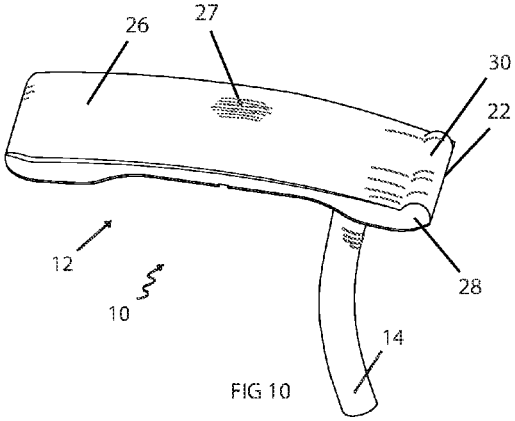
FIG 10
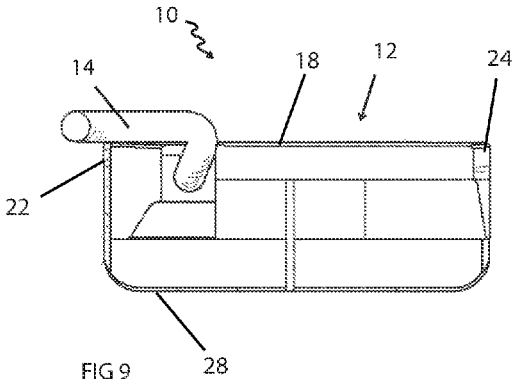
FIG 9

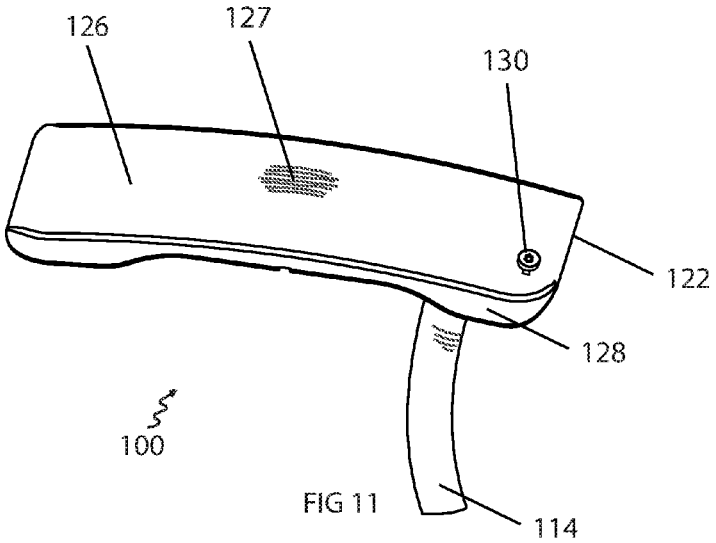
FIG 11
FIG 12
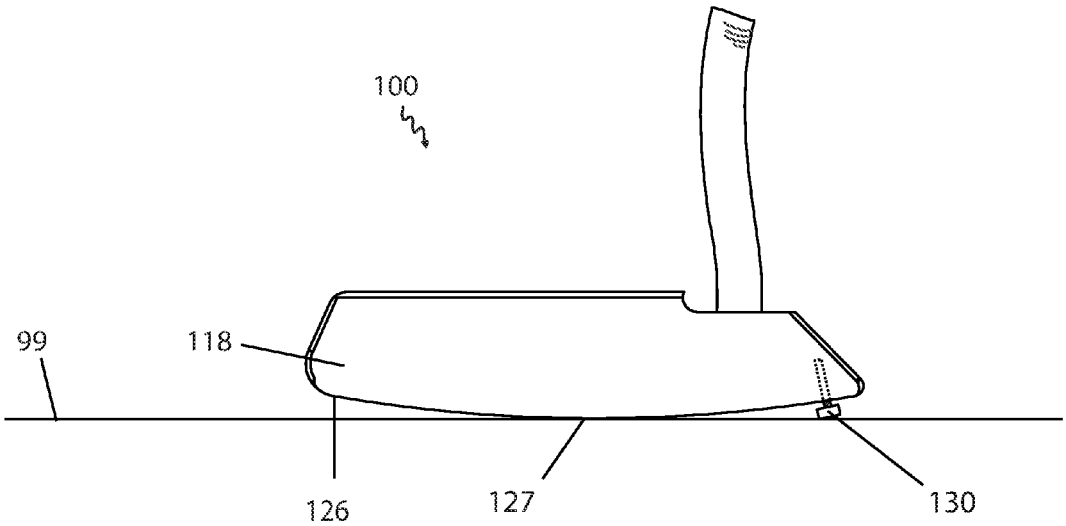

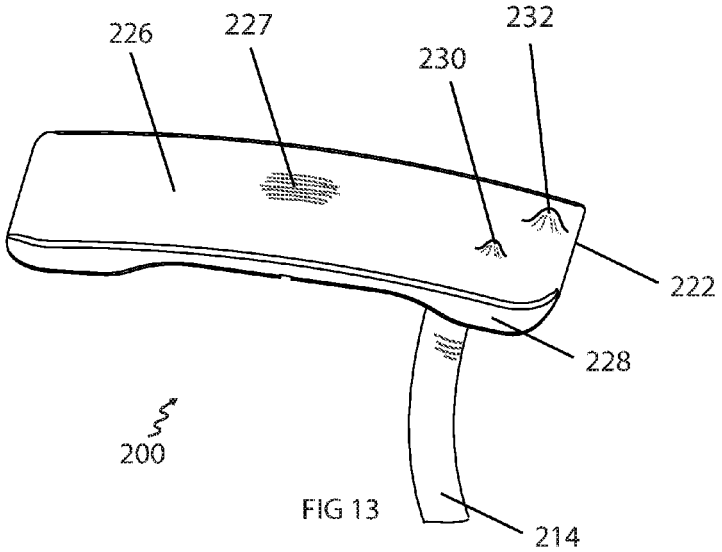
FIG 13
FIG 14
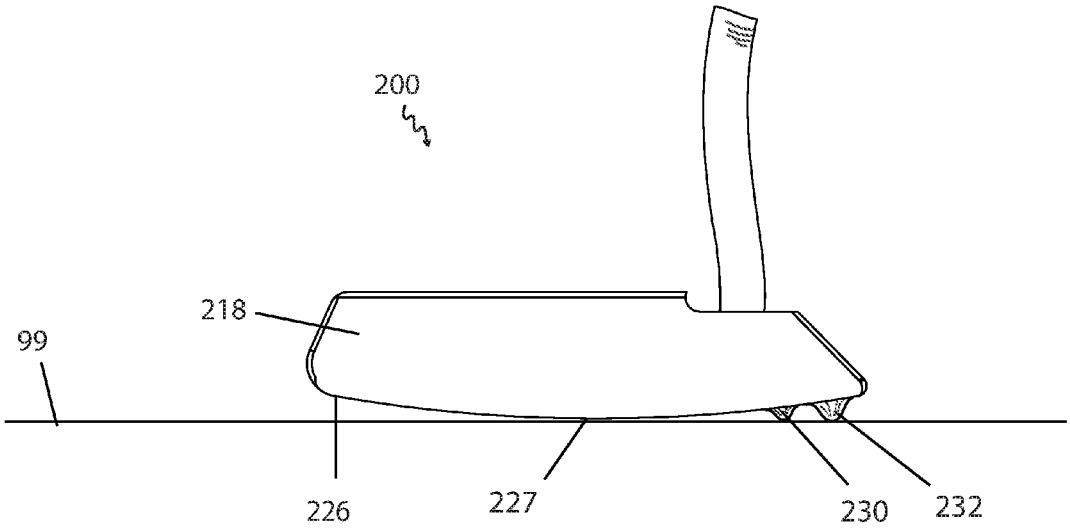

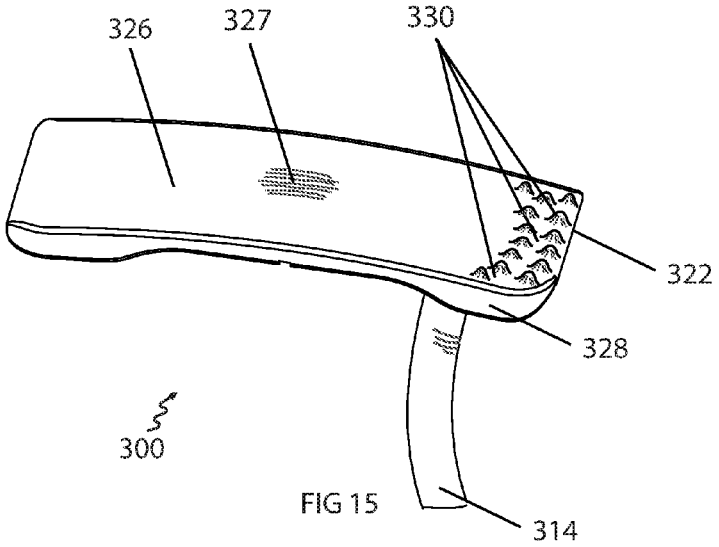
FIG 15
FIG 16
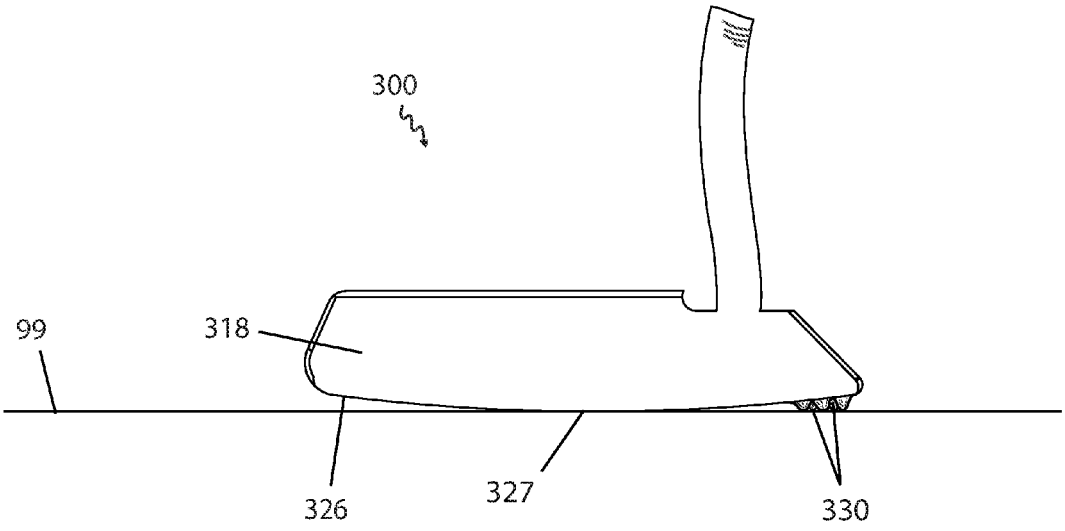

STAND ALONE GOLF CLUB WITH AUXILIARY GROUND ENGAGING SUPPORT MEMBERS

RELATED APPLICATIONS

The current application relies on the disclosure of Provisional Application No. 62/134,380 filed Mar. 17, 2015.

FIELD OF THE INVENTION

The present invention relates to golf clubs and in particular to putters designed and manufactured to stand alone in an upright position without having to be supported by a golfer.

BACKGROUND OF THE INVENTION

Most putter type golf clubs are built with steel shafts and are weighted and balanced such that the putter is unable to stand alone. It has been found that there are certain advantages using putters that are self-standing including giving a golfer the ability to leave the putter unattended in order to determine the correct line the golf ball should roll to the hole and thereafter align the putter head from the different perspective other than standing directly over the golf ball with the putter held in the golfer's hands.

Prior art stand-up or stand-alone putters are disclosed in U.S. Pat. No. 5,213,332 to Fahy et al, and U.S. Pat. No. 5,282,622 to Evans among others.

U.S. Pat. No. 6,634,956 to Pegg relates to a stand-up putter having a head mass of at least 14 ounces and a shaft and grip combination not exceeding 3 ounces.

U.S. Pat. No. 8,608,586 to Parente, et al is directed to another stand-up golf putter with a shaft not exceeding 49 grams to locate the balance point of the putter no further than 5 inches from the sole of the putter.

Application numbers 2004/0053703 to Snyder and 2008/0171614 to Anderson, et al show stand-up putters of additional interest, among others.

Typically, the prior art putters that are made to stand alone are often cumbersome and not well balanced making the execution of the actual putting stroke more difficult to repeat with any level of consistency when playing the game of golf.

SUMMARY OF THE INVENTION

The present invention relates to golf putters that incorporate new and beneficial features in their design and manufacture to allow them to facilitate the putter to better stand-alone without assistance from the golfer thereby providing unique playing characteristics and methods of use resulting in improved alignment and aiming features, player posture and fitting confirmation that creates a more favorable and beneficial setup position to enable the golfer to enhance the performance of each putting stroke at maximum potential.

The present invention is directed to a stand-alone putter type golf club formed of a putter head, a shaft connected to the putter head and a gripping means at the upper end of the shaft. The putter head is of conventional design including a ball striking face, an upper or top surface, a bottom sole for engaging the ground putting surface, a heel, toe and rear surface. The putter head may be a blade, mallet or heel/toe weighted design or other variations thereof commonly used in the golf industry. The putter can be formed of one piece or multiple pieces. The shaft may enter the head directly or it can be attached to the head via a hosel or with modular and adjustable adaptor components as is known the art.

The stand-alone putter features improved technology including a traditional to heavy head as compared to most conventional putter heads, either fixed or adjustable in weight and balance, a light shaft and grip combination as compared to most conventional putters, either fixed or adjustable, along with improved performance and methods of use.

A significant feature of the stand-alone putter of the present invention is the use of auxiliary, ground engaging, contact members located at the heel of the putter head that significantly stabilize the putter head in the stand alone position at an ideal or preferred lie and oriented square to the intended roll line when the club is free standing and not being held by the golfer. These ground contact support members can be located adjacent the heel on selected locations of the sole of the putter head to enable the members to contact the ground plane and maintain the putter oriented at an ideal lie and loft angle with the putter face toward the intended target line.

The support members may be formed in a variety of different shapes integral with the putter head or removable enabling adjustment for various conditions found on the putting surface. Typically, the support members are domed shaped and extend outwardly from the bottom sole of the putter head. Preferably they are located at or near the heel portion of the putter head opposite a shaft connection. The support members may take other shapes including flat tops or cylindrical members that extend across the sole of the putter head.

In most preferred embodiments of the invention, the ground contacting support members are located adjacent the heel of the putter and complement the primary, more centrally located, ground engaging flat section near the center of sole of the putter head that supports the majority of the weight of the putter.

In another embodiment, a putter with common sole radius in heel area has rails on the sole adjacent the heel of the putter head that run perpendicular to the face. A support shim can be attached to the rail to locate and facilitate the connection between the sole of the putter head and the support member rail.

The ground contact support members function to keep the putter free-standing alone with the putter face oriented in a square position relative to the intended line that is used to aim the putter to a target, and also position the golfer in the proper stance and setup for his or her ideal or preferred putter stroke mechanics.

The ground contact support members allow the overall shape and size of the putter head to be closer to conventional putter heads that cannot stand alone.

Specifically, the putter head can be made with near standard weight ranges, or heavy, being approximately 365 to 505 grams, as compared to putter heads on conventional putters that traditionally range of approximately between 330 and 360 grams. In addition, the combined shaft and gripping configuration of the putter of the present invention is extra light weighing between 22 and 68 grams and can have an integrally formed, grip area at the upper end of the shaft.

Typically, the ground support members are formed with the putter head. Alternatively, the ground contact support members could be affixed, attached or added on with epoxy or other means after putter head is manufactured. Any known manufacturing methods may be utilized for the head and ground contact support manufacture, including known methods and techniques such as by being investment cast, die cast, all types of metal injection molding, forging, stamping, hydroforming, 3D printing, or milling including CNC and manual milling, and others, or any combination of these processes. The support members may be unitary, formed as a plurality of members or formed as an array of support members.

Another feature of the putter of the present disclosure is a unique visual alignment system to insure the putter head is properly aligned to an intended target line. The alignment system can be located on the rear of the putter head where it can be seen from behind the putter at a distance when the putter is free-standing alone.

Unlike prior art traditional putters that usually have sight lines and slots that are designed to be used while holding the club in the playing position, the present invention has an alignment slot feature designed to be utilized for alignment and is only fully functional only when it is viewed from the rear while the putter is stable and positioned with square lie/loft/face angle towards the target line.

Among the objects of the present disclosure is the provision of an improved putter type golf club structured to stand-alone and be free-standing in an ideal or preferred playing position without aid of the golfer.

Another object in the disclosed subject matter is a putter type golf club having a more conventionally sized and shaped head design with ground engaging support members that is capable of standing up freely on a putting surface with a shaft and grip installed without support of a golfer.

Another object of the disclosed subject matter is that the ground contact support members can be made of a variety of materials, can be manufactured into the head as permanent fixtures, can be removable features such as one or more screws or other attachment means such as latches, interlocking tabs, quick connect devices or other known fasteners or connecting hardware.

Still another object is the provision of a stand-alone putter with a unique alignment structures that can be seen from the rear of the putter when the putter is standing upright, or a system that can be seen from address and the rear, or one that can be seen from address, or one that can be seen from only the front of the putter, or from the rear and the front of the putter.

Yet another object of this disclosure is a putter that provides an indication and positive reinforcement of the proper specifications of loft, lie and shaft lean and/or loft and other specifications to a golfer that has been properly fit to their own precise individual needs and preferences.

These and other objects and advantages will be understood with reference to the accompanying drawings and specification.

DESCRIPTION OF THE DRAWINGS

FIG. 8 is a rear perspective view of the putter of FIG. 4.

FIG. 9 is a top plan view of the putter of FIG. 4.

FIG. 10 is a bottom perspective view of the putter of FIG. 4.

FIG. 11 is a bottom perspective view of a second embodiment of a putter head in accordance with the present invention.

FIG. 12 is a front elevational view of the putter of FIG. 11.

FIG. 13 is a bottom perspective view of a third embodiment of a putter head in accordance with the present invention.

FIG. 14 is a front elevational view of the putter of FIG. 13.

FIG. 15 is a bottom perspective view of a fourth embodiment of a putter head in accordance with the present invention.

FIG. 16 is a front perspective view of the putter of FIG. 15.

DESCRIPTION OF THE PREFERRED EMBODIMENTS

Figure 1:
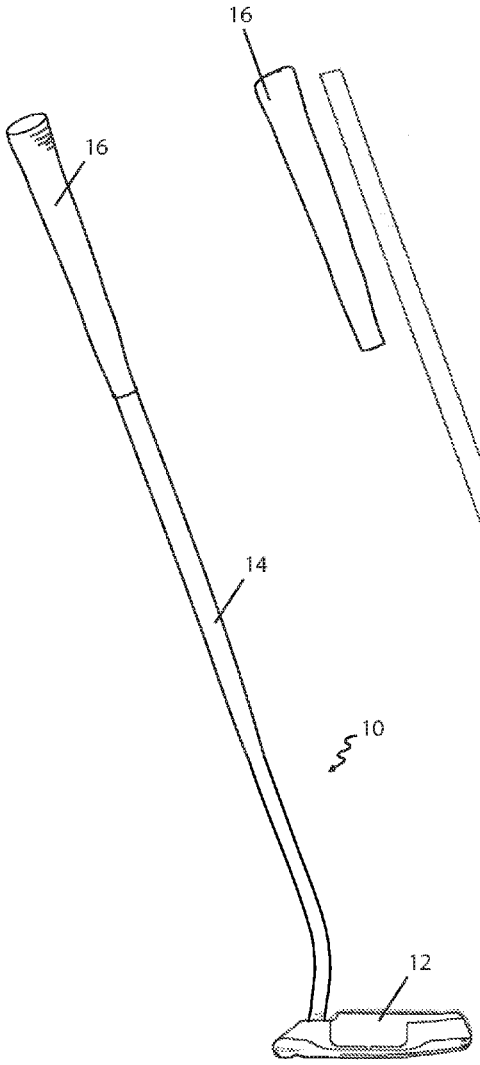
FIG. 1 is a perspective view of a putter type golf club suitable for use with the present invention.
Figure 2:
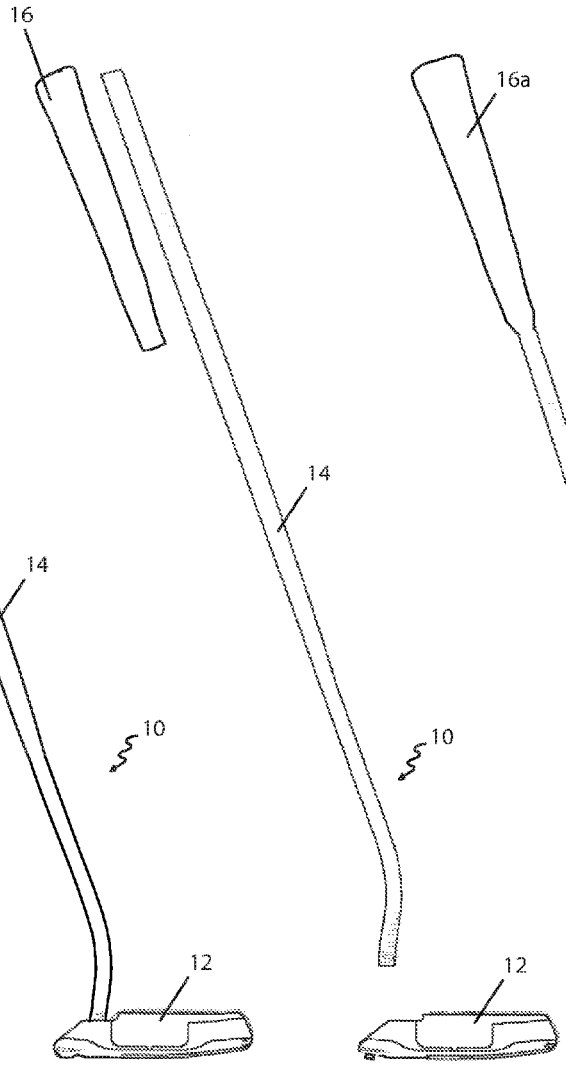
FIG. 2 is an exploded, perspective view of a second putter type golf club for use with the present invention.
Figure 3:
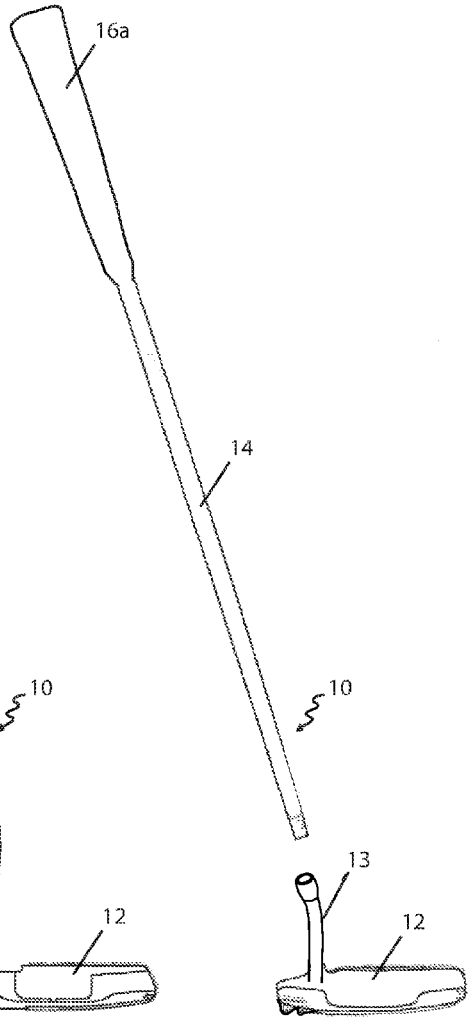
FIG. 3 is an exploded, perspective view of a third putter type golf club for use with the present invention.
Figure 5:
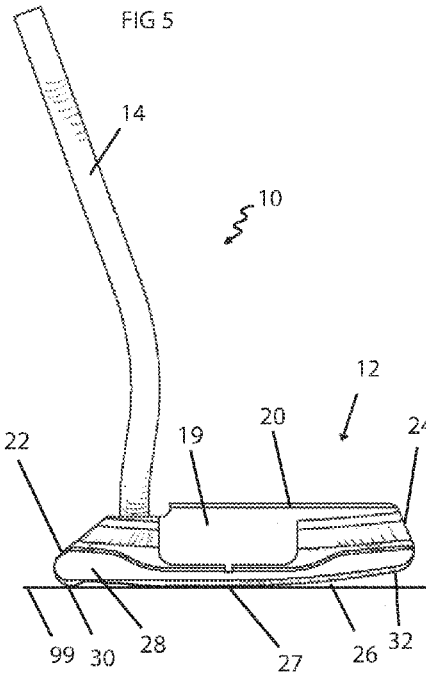
FIG. 5 is a rear elevational view of the putter of FIG. 4.
Figure 6:
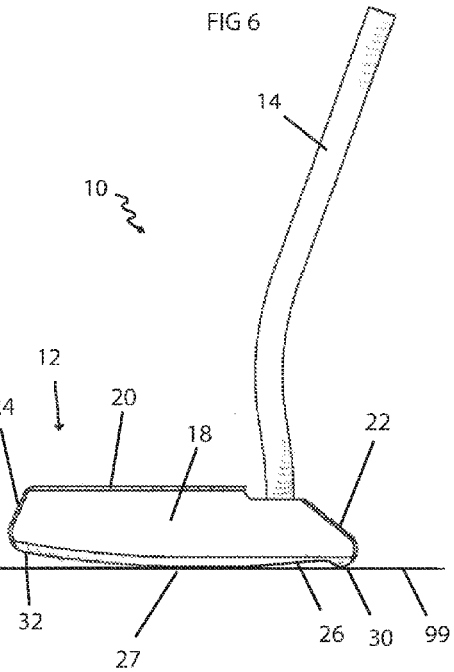
FIG. 6 is a front elevational view of the putter of FIG. 4.
Figure 4:
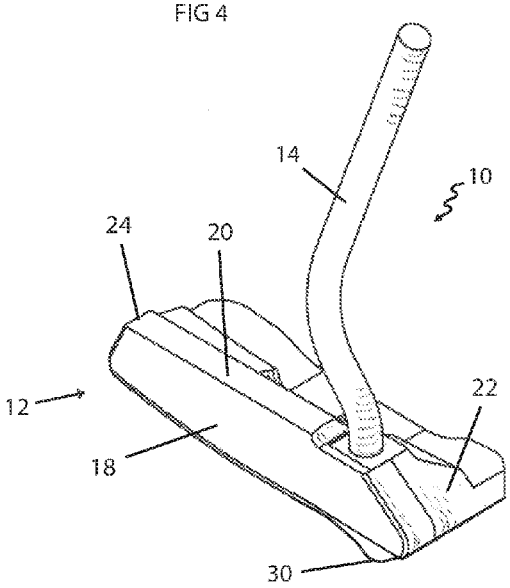
FIG. 4 is a front perspective view of a first embodiment of a putter head in accordance with the present invention.
Figure 7:
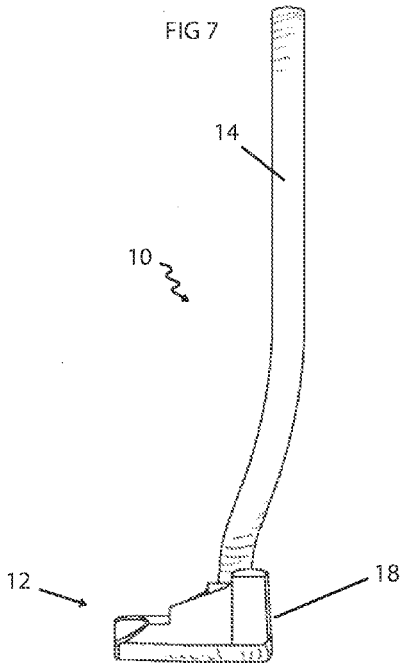
FIG. 7 is a toe side elevational view of the putter of FIG. 4.
Figure 19:
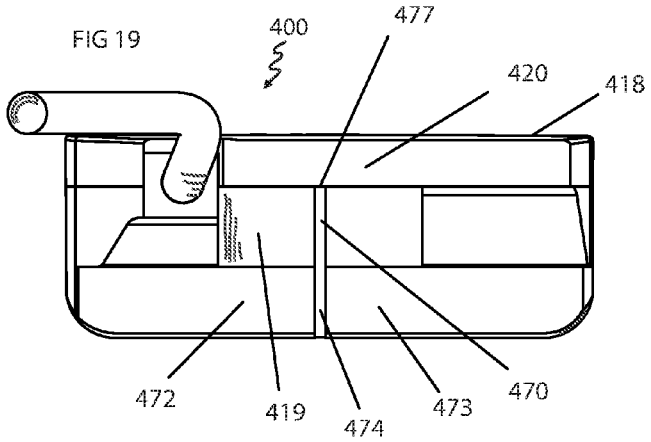
FIG. 19 is a top plan view of the putter head of FIG. 17.
Figure 18:
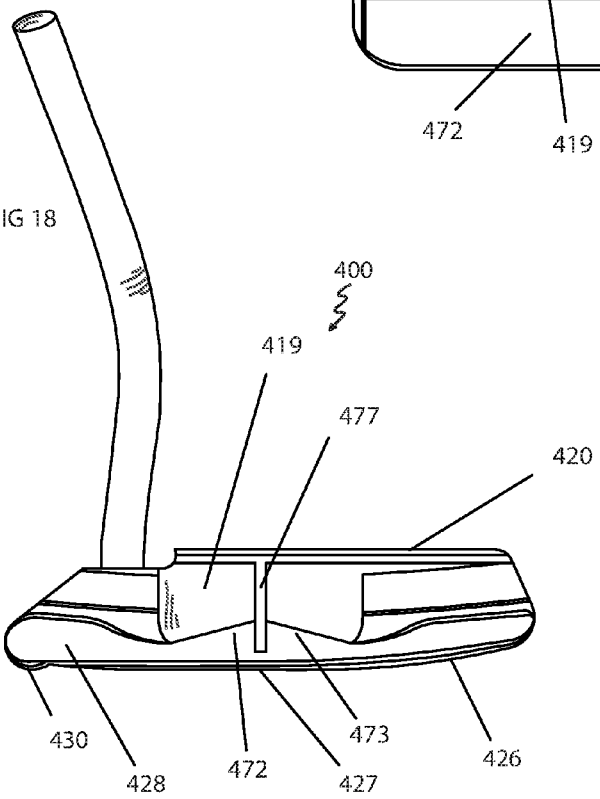
FIG. 18 is a rear elevational view of the putter head of FIG. 17.
Figure 17:
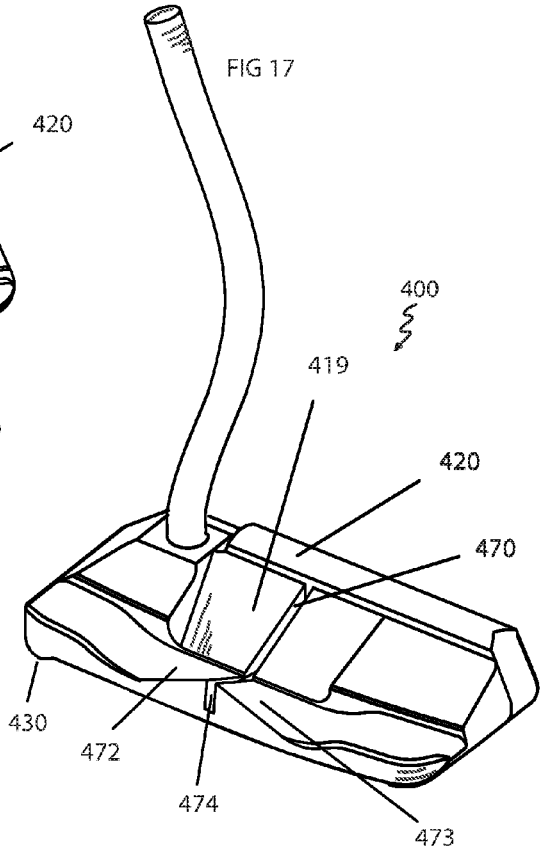
FIG. 17 is a rear perspective view of a fifth embodiment of a putter head in accordance with the present invention.
Figure 20:
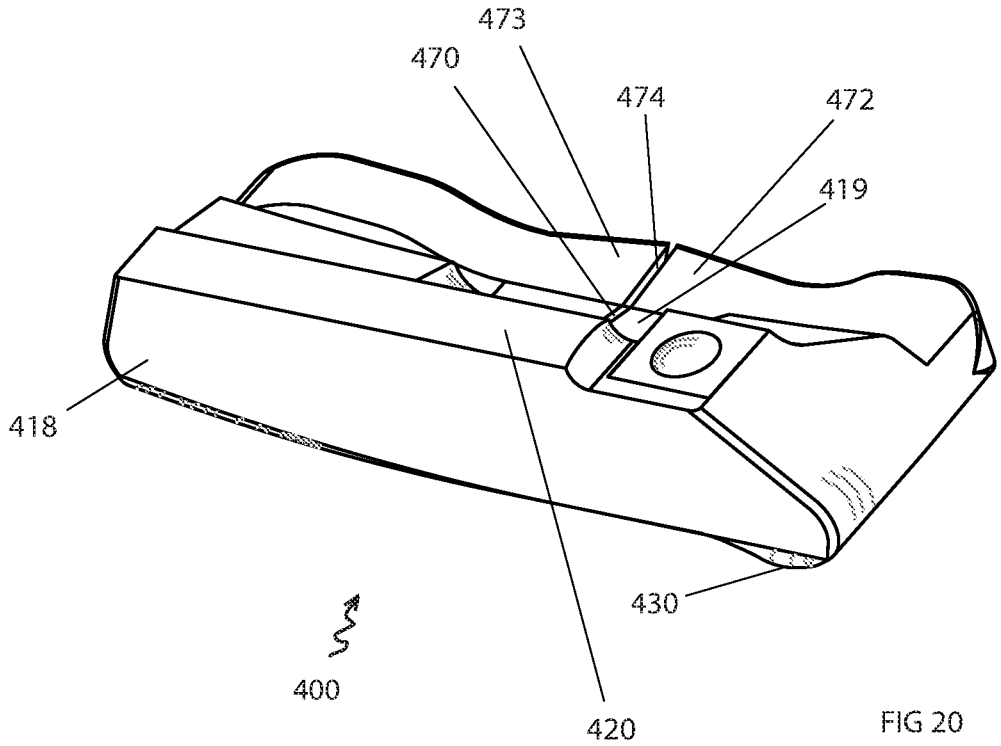
FIG. 20 is a front perspective view of the putter head of FIG. 17 without a connected shaft.

FIG. 1 illustrates a putter type golf club 10 suitable for use with the present invention and includes a putter head 12, a shaft 14 and grip 16. FIG. 2 illustrates a similar putter 10 where the shaft 14 and grip 16 are interchangeable. FIG. 3 illustrates another putter 10 where the putter head 12 includes a hosel 13 and is detachable from the one-piece shaft and grip 14 with gripping surface 16*a*. It will be appreciated the putter 10 is a stand-alone type with a heavy head as compared to conventional putter heads and a very light shaft and grip combination as compared to conventional putters.

In order to stand alone, the putter head 12 is relatively heavy, being approximately 365-505 grams, as compared to conventional putter heads that traditionally are in the range of 330 to 360 grams. The shaft 14 is light weight and can have an integrally formed grip section 16*a* at the upper end of the shaft or the shaft 14 can be standard diameter with a light weight grip 16. The total weight of the shaft 14 and grip section 16 or 16*a* is between 22 and 68 grams. The grip area 16*a*, when integrally formed, can eliminate the need for a conventional slide-on rubber or composition grip that is attached after the putter is assembled.

Figure 31:
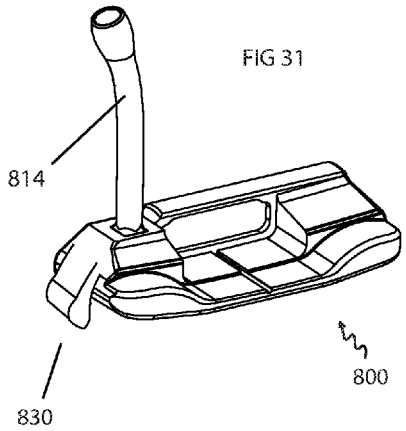
FIG. 31 shows a rear perspective view of an ninth embodiment of a putter head of the present invention.
Figure 34:
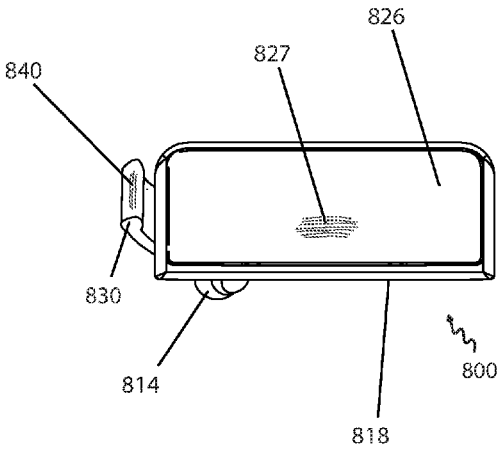
FIG. 34 shows a bottom of the putter shown in FIG. 31.

It will be appreciated that various models of putter heads may be used in keeping within the scope of the present invention such as a blade, mallet or heel/toe weighted design or other variations thereof commonly used in the golf industry and marketplace. Therefore, the putter head 12 may include a rear cavity and/or rear projections, see FIGS. 31 and 33, depending upon the configuration of the model of the putter head.

Referring to FIGS. 4 to 10 a stand-alone putter 10 of the type described above includes a putter head 12 having a frontal ball striking face 18, rear face 19, top surface 20, heel 22, toe 24, bottom sole 26 and rear surface 28. The bottom sole 26 has a centrally located, ground contact area 27. The putter head 12 rests on and engages the putting surface 99 when standing alone or when it is held at address by a golfer prior to the execution of a putting stroke. It will be appreciated the putter 10 is shown only with a portion of a shaft 14 and the putter head 12, whereas the putter 10 is a conventional length with a lightweight shaft and grip, not shown. Putters in embodiments hereinbelow are similarly shown and described.

In addition to the central contact area 27 on the bottom sole 26, the putter head 12 of the present invention is provided with at least one auxiliary ground contact, support member 30 located adjacent the heel 22 on the underside or sole 26 of the putter head 12 that keeps the putter head 12 stable and square to the intended roll line when the club is free standing and not being held by the golfer. In this embodiment, the support member has a parabolic or round outer, ground engaging shape and is located at the end of the bottom sole 26 adjacent the heel 22 and extends from the striking face 18 to the rear surface 28. The ground contact, support member 30 raises the heel 22 slightly above the ground except directly under the support member 30. A critical design feature of the support member 30 is that it extends down from the sole so that it contacts the ground while the putter is at true lie/loft/face angle. This structure allows the putter 10 to balance itself and stabilizes the putter because the weight of the shafted putter 10 is supported and balanced between the center ground contact area 26 and the support member 30 contacts a ground or putting surface 99. Putters with traditional weight and footprint area would fall down or lean or rock so that they are not consistently balanced at intended true lie/loft/face angle.

FIGS. 11 and 12 illustrate an alternate embodiment of a putter 100 of the present invention. The putter 100 is basically the same structure as described above including a putter head 112 and striking face 118 with the exception that a single ground engaging support member 130 is shown at the heel 122 adjacent the rear surface 128 on the bottom sole 126 of the putter head 100. In this version, the ground contact area 127 and the support member 130 engage the putting surface 99 to maintain the putter 100 in a stand-alone position. In this embodiment, the ground engaging support member is shown as a removable screw like attachment that is inserted into and engages the sole 126 of the putter head 100.

FIGS. 13 and 14 illustrate another putter head 200 having an alternate version of a ground contact support formed of two raised, domed support members 230 and 232 on the sole 226 of the putter head 200. In this embodiment, the support members 230 and 232 are slightly offset from each other and are located adjacent the heel 222 and rear surface 228 of the putter head 200.

FIGS. 15 and 16 illustrate still another alternate embodiment of a putter type golf club head 300 having an alternate version of a ground contact support formed of an array of multiple, individual support members 330 on the sole 326 of the putter head 300. In this embodiment the support members 330 are located the heel 322 closer to the rear surface 328 of the putter head 300. The support members 330 may be formed of a plurality of raised domed supports or a plurality of elongated parabolic members of the type shown in FIGS. 4 to 10.

FIGS. 17, 18, 19 and 20 illustrate a putter head 400 having a similar structure to the putter head 10 described above formed with a striking face 418 and a ground contact support 430. This present embodiment of the putter head 400 includes a unique alignment system that is used when the putter head 400 stands alone. The rear face 419 of the putter head 400 is sloped away from the top surface 420 downwardly at an angle toward the rear surface 428 of the putter head 400. A slot 470 is cut into the rear face 419. A back wall of the slot 470 forms an alignment image 477 that is visible through the slot 470 when viewed from directly behind the putter head 400 to properly align a putter 10 to an intended target. Preferably the alignment image 477 is painted a bright color to make it more visible in a variety of lighting conditions. The geometry that creates the slot 470 does not have to be a sloped ramp. The bottom surface of the slot 470 that forms the alignment image 477 could be concave, convex or another shape as long as it is visible when the golfer stands behind the putter standing on the putting surface. The alignment feature extends between rear flange sections 472 and 473 as an elongated slot 478 extending rearwardly from the striking face 418.

It will be appreciated that the alignment feature is used with the putter 10 standing alone allowing a golfer to view the putter head 400 from behind in order that the alignment image 477 of the slot 470 is seen only when the putter head is properly aligned to the intended target. If the alignment image 477 is not seen, the putter is not aligned to the target direction as visualized by the golfer standing behind the putter. It then becomes a relatively easy task to reset the putter until the alignment image 477 is easily seen ensuring the putter is properly aligned.

The alignment feature may also be used when a golfer stands in front of the putter head 400, for example for short putts where the golfer is beyond the hole and does not interfere with the putting line, to further insure the putter head is properly aligned. A second alignment slot 474 extends rearwardly and is recessed between rear flange sections 472 and 473. As with the alignment image 477, a bottom portion of the slot 474 is painted with a bright color that can only be seen from the front when the putter head 400 is properly aligned.

Figure 21:
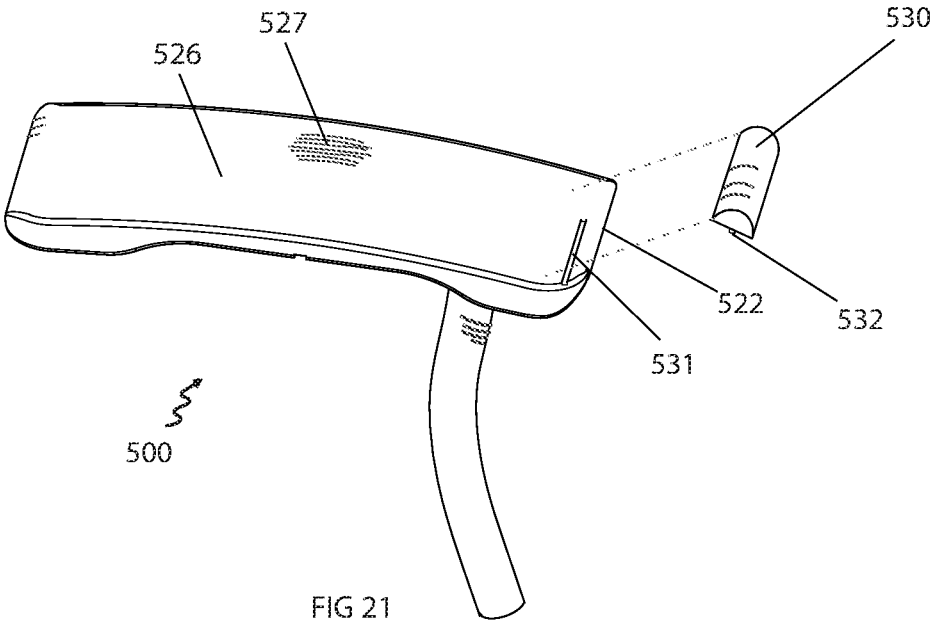
FIG. 21 is a bottom rear perspective exploded view of a sixth embodiment of a putter head and a removable ground engaging member in accordance with the present invention.
Figure 22:
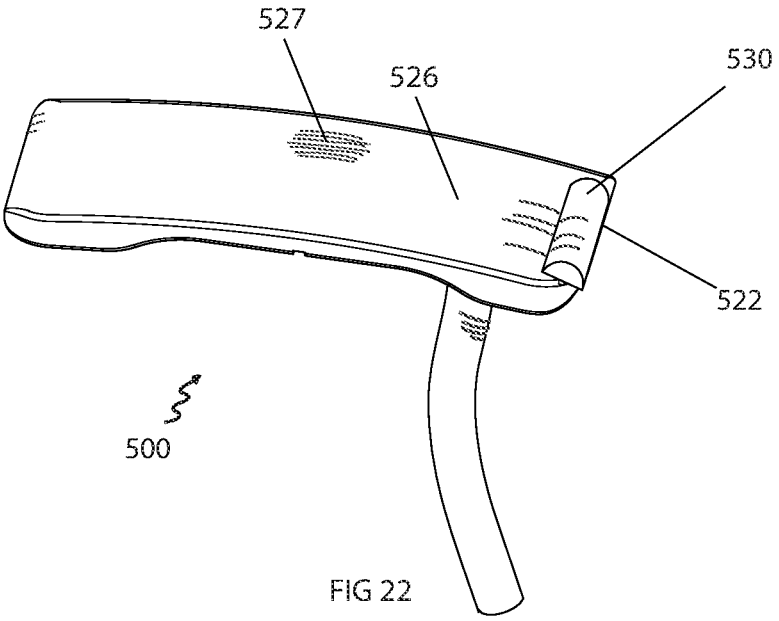
FIG. 22 shows a view of the putter of FIG. 21 with the ground engaging member connected to the putter head.
Figure 24:
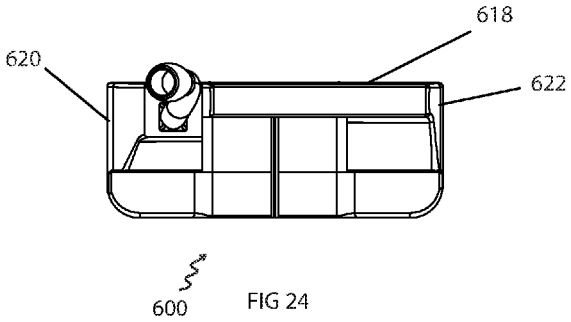
FIG. 24 shows a top plan view of the putter shown in FIG. 23.
Figure 25:
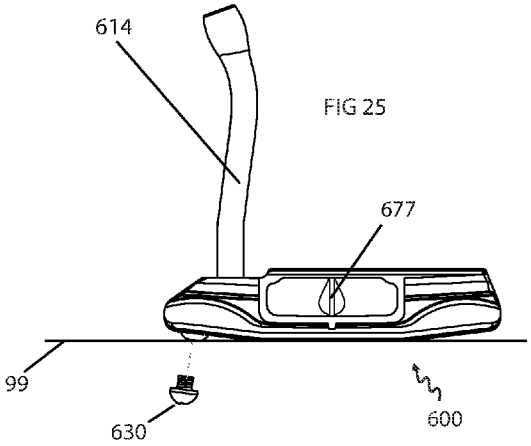
FIG. 25 shows an exploded rear elevational view of the putter shown in FIG. 23.
Figure 23:
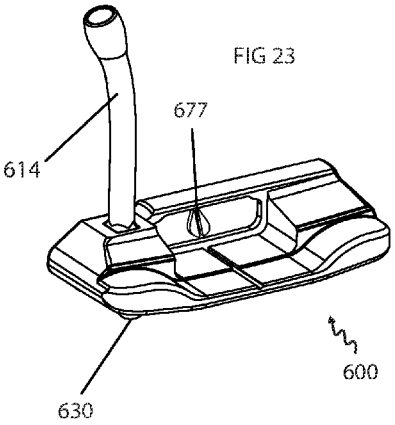
FIG. 23 shows a rear perspective view of a seventh embodiment of a blade type putter head of the present invention.
Figure 26:
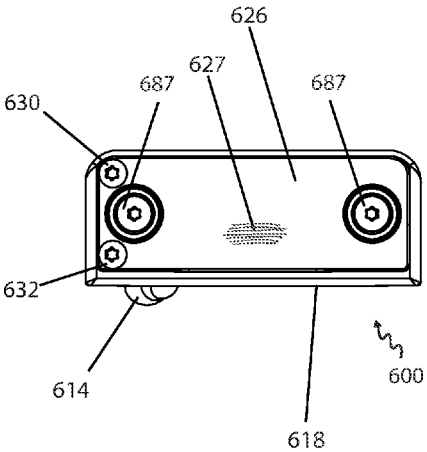
FIG. 26 shows a bottom view of the putter shown in FIG. 23.
Figure 28:
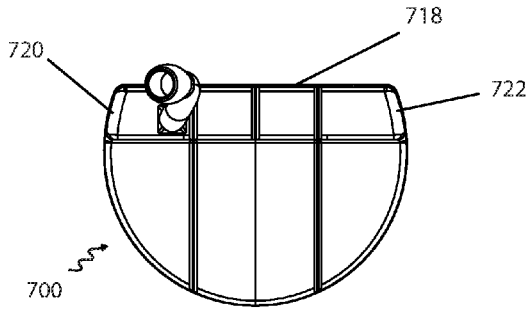
FIG. 28 shows a top plan view of the putter shown in FIG. 27.
Figure 29:
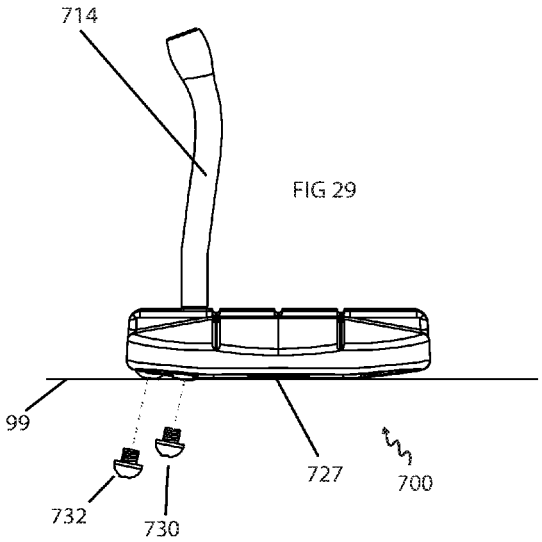
FIG. 29 shows an exploded rear elevational view of the putter shown in FIG. 27.
Figure 27:
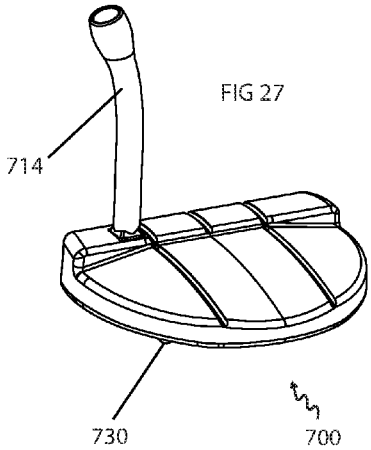
FIG. 27 shows a rear perspective view of an eighth embodiment of a mallet type putter head of the present invention.
Figure 30:
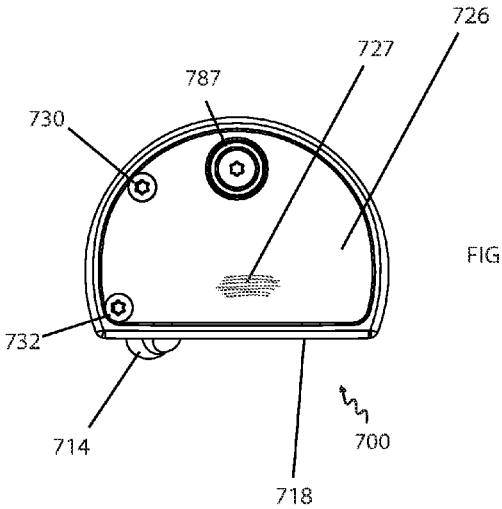
FIG. 30 shows a bottom view of the putter shown in FIG. 27.
Figure 32:
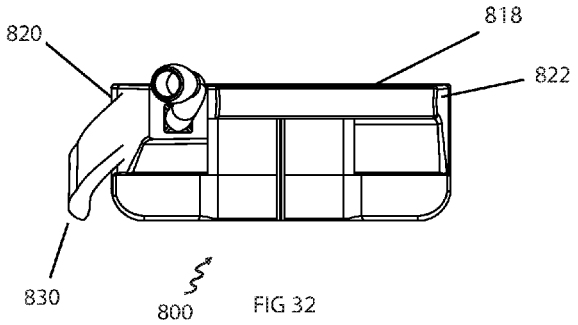
FIG. 32 shows a top plan view of the putter shown in FIG. 31.

FIGS. 21 and 22 show a sixth embodiment of a stand-alone, putter head 500 that is basically the same as the embodiment of FIG. 10 except a ground engaging support member 530 is removably attached to the bottom sole 526.

A slot 531, located adjacent the heel 522 on the bottom sole 526, engages a rail 532 on the lower flat end of the removable support member 530 to secure the support member 530 in place when a golfer elects to use the putter in a stand-alone mode. Should the golfer elect to use the putter in a more conventional manner, the support member 530 can be removed. It will be appreciated that a removable support member may take a variety of sizes, shapes, materials and weights and may be attached by any attachment device.

FIGS. 23, 24, 25 and 26 show a seventh embodiment of a stand-alone, blade type putter head 600 including a hosel 614 integrally formed with the putter head 600 for connection to a conventional shaft and grip, not shown. The putter head 600 is conventional in design and includes a frontal golf ball striking face 618, heel 620, toe 622 and bottom sole 626 that has a slight radius forming a putting surface contact point essentially in the center of the bottom sole. In a preferable design, the bottom sole includes a pair of adjustable weight plugs 687 adjacent the on either side of the bottom sole 626. A pair of ground engaging support members 630 and 632, in the form of rounded screw heads, are attached into a threaded bore in the sole 626 adjacent the heel 620 of the putter club head 600. The support members 630 and 632 form protrusions and extend outwardly from the sole 626 in order to engage the putting surface and keep the putter in a stand-alone position. As with the last embodiment, the support members 630 and 632 may be removed when the putter is not used in a stand-alone configuration.

FIGS. 27, 28, 29 and 30 show an eighth embodiment of a mallet type putter head 700 including a hosel 714 for connection to a conventional golf shaft, not shown, integrally formed with the putter head 700.

The putter head 700 is conventional in design and includes a frontal golf ball striking face 718, heel 720, toe 722 and bottom sole 726 that has a slight radius forming a putting surface contact point essentially in the center of the bottom sole. In a preferable design, the bottom sole includes adjustable weight plugs 787 on the bottom sole 726. A pair of ground engaging support protrusions 730 in the form of rounded screw heads that are attached to the sole 730 adjacent the heel 720 and toe 722. The support protrusions 730 and 732 extend outwardly from the sole 726 in order to engage the putting surface and keep the putter in a stand-alone position. As with the last embodiment, the protrusions 730 and 732 may be removed when the putter is not used in a stand-alone configuration.

FIGS. 31, 32, 33 and 34 show a putter head 800 including a hosel 814 for connection to a shaft. The putter 800 is formed having an outrigger shaped, ground engaging member 830 integrally formed with and attached to the heel 822 of the putter head. The outrigger shaped, ground engaging member 830 extends downwardly from the heel 822 in a gently shaped curve whereby the bottom edge 827 of the member 830 extends toward the ground supporting surface approximately in-line with the central, ground engaging portion of the bottom sole 826.

Figure 33:
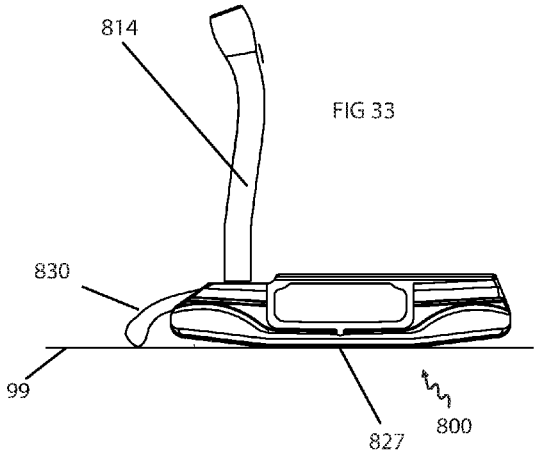
FIG. 33 shows an exploded rear elevational view of the putter shown in FIG. 31.

As is seen in FIG. 33 when the putter 800 is positioned flat on a putting ground surface both the central part of the bottom sole 826 and the bottom edge 827 of the ground engaging member contact the support surface such that the ground support member 830 aids in maintaining the putter 800 upright in a stand-alone position.

Alternately, the ground engaging member 830 may be removably attached to the heel 822, not shown, in order to enable a golfer to use the putter 800 without the stand alone feature. In addition, other shapes may be attached to the putter 800 above the sole 826 to support the putter in a stand-alone position.

Although there are a number of modifications of a stand-alone putter with ground engaging members shown, it will be appreciated that the invention is not limited to those and that additional modifications may be made in keeping within the spirit and scope of the following claims.

The invention claimed is:

1. A stand-alone putter structured and weight balanced enabling the putter to stand upright at an intended lie and loft position on a putting surface without outside support, comprising:

a club head, a shaft connected to said club head and a gripping area at an upper end of said shaft;

said club head including a ball striking face, a rear surface, a heel, a toe, an upper surface and a bottom sole;

said bottom sole forming a unitary bottom surface across the entire bottom area of said club head extending continuously and hole-less from said ball striking face to said rear surface and from said heel to said toe; said bottom sole having a centrally located, first ground support surface for support the putter in a conventional use position with said bottom sole lying on a putting surface;

and, said club head further including at least one auxiliary ground engaging, support member attached to said bottom sole adjacent said heel and extending downward from said bottom sole of said club head, whereby said auxiliary ground engaging, support member contacts the putting surface forming a second additional ground engaging support to maintain the putter in a stand-alone, upright position on the putting surface.

2. The stand-alone putter of claim 1 being further defined by said additional ground engaging, support member being formed of a plurality of ground engaging members.

3. The stand-alone putter of claim 2 wherein said plurality of ground engaging members is two.

4. The stand-alone putter of claim 2 wherein said ground engaging members are dome shaped.

* * * * *